US008831498B2

(12) United States Patent
Iwaya et al.

(10) Patent No.: US 8,831,498 B2
(45) Date of Patent: Sep. 9, 2014

(54) FIXING DEVICE AND GUIDE MECHANISM INCLUDED THEREIN

(71) Applicants: Naoki Iwaya, Tokyo (JP); Masahiko Satoh, Tokyo (JP); Masaaki Yoshikawa, Tokyo (JP); Hiroshi Yoshinaga, Chiba (JP); Kenji Ishii, Kanagawa (JP); Tadashi Ogawa, Tokyo (JP); Hiromasa Takagi, Tokyo (JP); Takeshi Uchitani, Kanagawa (JP); Takuya Seshita, Kanagawa (JP); Takahiro Imada, Kanagawa (JP); Hajime Gotoh, Kanagawa (JP); Akira Suzuki, Tokyo (JP); Teppei Kawata, Kanagawa (JP); Toshihiko Shimokawa, Kanagawa (JP); Arinobu Yoshiura, Kanagawa (JP); Takamasa Hase, Shizuoka (JP); Shuutaroh Yuasa, Kanagawa (JP); Kensuke Yamaji, Kanagawa (JP)

(72) Inventors: Naoki Iwaya, Tokyo (JP); Masahiko Satoh, Tokyo (JP); Masaaki Yoshikawa, Tokyo (JP); Hiroshi Yoshinaga, Chiba (JP); Kenji Ishii, Kanagawa (JP); Tadashi Ogawa, Tokyo (JP); Hiromasa Takagi, Tokyo (JP); Takeshi Uchitani, Kanagawa (JP); Takuya Seshita, Kanagawa (JP); Takahiro Imada, Kanagawa (JP); Hajime Gotoh, Kanagawa (JP); Akira Suzuki, Tokyo (JP); Teppei Kawata, Kanagawa (JP); Toshihiko Shimokawa, Kanagawa (JP); Arinobu Yoshiura, Kanagawa (JP); Takamasa Hase, Shizuoka (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/795,267

(22) Filed: Mar. 12, 2013

(65) Prior Publication Data

US 2013/0251422 A1 Sep. 26, 2013

(30) Foreign Application Priority Data

Mar. 22, 2012 (JP) ..... 2012-064614

(51) Int. Cl.
*G03G 15/20* (2006.01)

(52) U.S. Cl.
USPC ..... 399/329; 399/328

(58) Field of Classification Search
USPC ..... 399/328–331
See application file for complete search history.

(56) References Cited

U.S. PATENT DOCUMENTS 5,300,996 A 4/1994 Yokoyama et al.
5,832,354 A 11/1998 Kouno et al.

(Continued)

FOREIGN PATENT DOCUMENTS

JP 2007-334205 12/2007
JP 2010-096782 4/2010

(Continued)

OTHER PUBLICATIONS

Unpublished U.S. Appl. No. 13/608,128, filed Sep. 10, 2012.

*Primary Examiner* — Hoang Ngo
(74) *Attorney, Agent, or Firm* — Harness, Dickey & Pierce, P.L.C.

(57) ABSTRACT

A fixing device includes a rotatable, endless flexible belt, an elongated stationary pad, a rotatable pressure member, a rotary driver, a releasable biasing mechanism, a first guide member, and a second guide member. The endless flexible belt is looped into a generally cylindrical configuration. The elongated stationary pad is stationarily disposed inside the loop of the belt. The rotatable pressure member is disposed parallel to the stationary pad with the belt interposed between the pressure member and the stationary pad. The rotary driver is operatively connected with the pressure member to impart torque to the pressure member. The releasable biasing mechanism is operatively connected with the pressure member to apply a releasable pressure to the pressure member against the belt in a load direction. The first guide member defines a first elongated opening. The second guide member defines a second elongated opening.

19 Claims, 10 Drawing Sheets

(56) References Cited

U.S. PATENT DOCUMENTS

| | | | | |
|---|---|---|---|---|
| RE36,124 | E | 3/1999 | Hiroshi et al. | |
| 5,915,147 | A | 6/1999 | Kouno et al. | |
| 8,050,608 | B2 * | 11/2011 | Chang | 399/328 |
| 8,295,751 | B2 * | 10/2012 | Souda et al. | 399/329 |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0016963 | A1 | 1/2003 | Yoshinaga et al. | |
| 2003/0206758 | A1 | 11/2003 | Yasui et al. | |
| 2004/0013453 | A1 | 1/2004 | Shinshi et al. | |
| 2004/0247334 | A1 | 12/2004 | Kishi et al. | |
| 2004/0258426 | A1 | 12/2004 | Kishi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0129432 | A1 | 6/2005 | Sato et al. | |
| 2005/0163543 | A1 | 7/2005 | Satoh et al. | |
| 2006/0051120 | A1 | 3/2006 | Kishi et al. | |
| 2006/0116230 | A1 | 6/2006 | Satoh et al. | |
| 2006/0165429 | A1 | 7/2006 | Satoh et al. | |
| 2006/0165448 | A1 | 7/2006 | Yoshinaga | |
| 2006/0177232 | A1 | 8/2006 | Ehara et al. | |
| 2006/0182460 | A1 | 8/2006 | Kishi et al. | |
| 2006/0285893 | A1 | 12/2006 | Ishii | |
| 2007/0014600 | A1 | 1/2007 | Ishii et al. | |
| 2007/0014603 | A1 | 1/2007 | Satoh et al. | |
| 2007/0059011 | A1 | 3/2007 | Seo et al. | |
| 2007/0059071 | A1 | 3/2007 | Shinshi et al. | |
| 2007/0110464 | A1 | 5/2007 | Nakayama et al. | |
| 2007/0212089 | A1 | 9/2007 | Seo et al. | |
| 2007/0280754 | A1 | 12/2007 | Ogawa et al. | |
| 2007/0292175 | A1 | 12/2007 | Shinshi | |
| 2008/0044196 | A1 | 2/2008 | Seo et al. | |
| 2008/0063443 | A1 | 3/2008 | Yoshinaga et al. | |
| 2008/0253789 | A1 | 10/2008 | Yoshinaga et al. | |
| 2008/0317532 | A1 | 12/2008 | Ehara et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0020018 | A1 | 1/2011 | Takenaka et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0076071 | A1 | 3/2011 | Yamaguchi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0170917 | A1 | 7/2011 | Yoshikawa et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2013/0045032 | A1 | 2/2013 | Shimokawa et al. | |

FOREIGN PATENT DOCUMENTS

| | | |
|---|---|---|
| JP | 2010-096823 | 4/2010 |
| JP | 2011-022430 | 2/2011 |
| JP | 2011-028037 | 2/2011 |

* cited by examiner

FIXING DEVICE AND GUIDE MECHANISM INCLUDED THEREIN

CROSS-REFERENCE TO RELATED APPLICATIONS

The present patent application claims priority pursuant to 35 U.S.C. §119 from Japanese Patent Application No. 2012-064614, filed on Mar. 22, 2012, which is hereby incorporated by reference herein in its entirety.

BACKGROUND OF THE INVENTION

1. Technical Field

The present invention relates to a fixing device and a guide mechanism included therein, and more particularly, to a fixing device for use in an image forming apparatus, such as a photocopier, facsimile machine, printer, plotter, or multifunctional machine incorporating several of these features, and a mechanism for guiding movement of a rotatable pressure member included in the fixing device.

2. Background Art

In electrophotographic image forming apparatuses, such as photocopiers, facsimile machines, printers, plotters, or multifunctional machines incorporating several of these features, an image is formed by attracting developer or toner particles to a photoconductive surface for subsequent transfer to a recording medium such as a sheet of paper. After transfer, the imaging process is followed by a fixing process using a fixing device, which permanently fixes the toner image in place on the recording medium with heat and pressure.

In general, a fixing device employed in electrophotographic image formation includes a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, heat from the fuser member causes the toner particles to fuse and melt, while pressure between the fuser and pressure members causes the molten toner to set onto the recording medium.

Various methods have been proposed to provide a fast, reliable fixing process that can process a toner image with short warm-up time and first-print time without causing image defects even at high processing speeds.

For example, a known belt-based fixing device employs an endless flexible fuser belt looped into a generally cylindrical configuration, with a stationary fuser pad disposed inside the loop of the belt. Opposite the fuser belt extends a pressure roller that presses against the fuser pad via the belt to form a fixing nip therebetween. The pressure roller is connected with a rotary driver via a gear train, including an output gear and its mating, idle gear, from which torque is transmitted to rotate the pressure roller to in turn rotate the fuser belt in frictional contact with the roller at the fixing nip.

Optionally, the fuser assembly is equipped with a tubular holder of thermally conductive metal, or heat pipe, disposed inside the loop of the fuser belt for heating the fuser belt through conduction. A heater is disposed inside the heat pipe, from which heat is imparted to the entire circumference of the fuser belt looped around the heat pipe. A generally flat, reinforcing plate is provided in contact with the fuser pad to reinforce the fuser pad.

In this fixing device, a releasable biasing mechanism is provided to move the pressure roller away from the fuser belt to release pressure between the pressure roller and the fuser belt. Releasing nip pressure prevents deformation of the fuser belt and the pressure roller, which would occur where the fixing members are continuously subjected to a substantial nip pressure for an extended period of non-operation, while facilitating removal of jammed recording media from between the fuser belt and the pressure roller.

The inventors have recognized that releasing nip pressure through movement of the pressure member, although generally successful for its intended purpose, may create difficulties in the fixing device.

Specifically, one approach to releasing nip pressure is to move the pressure roller away from the fuser belt in a straight direct path along a load direction in which the pressure roller exerts pressure against the fuser belt. Such movement of the pressure roller does not require a substantial space for accommodating the moving roller, while entailing a risk of sudden disengagement of the output gear from the idler gear, which would result in damage and other adverse consequence to the gear train where adjacent gear teeth strike each other during movement of the pressure roller.

Another approach is to move the pressure roller away from the fuser belt in a curved, circumferential path around a given rotational axis. Compared to straight movement, curved movement of the pressure roller can maintain proper engagement between the mating gears, thereby eliminating failure due to interference between gear teeth. However, this approach requires an extensive space for accommodating the moving roller. Moreover, increasing the range of movement of the pressure roller would cause increased interference of the pressure roller with its surrounding structure.

SUMMARY OF THE INVENTION

Exemplary aspects of the present invention are put forward in view of the above-described circumstances, and provide a novel fixing device.

In one exemplary embodiment, the fixing device includes a rotatable, endless flexible belt, an elongated stationary pad, a rotatable pressure member, a rotary driver, a releasable biasing mechanism, a first guide member, and a second guide member. The endless flexible belt is looped into a generally cylindrical configuration. The elongated stationary pad is stationarily disposed inside the loop of the belt. The rotatable pressure member is disposed parallel to the stationary pad with the belt interposed between the pressure member and the stationary pad. The rotary driver is operatively connected with the pressure member to impart torque to the pressure member. The releasable biasing mechanism is operatively connected with the pressure member to apply a releasable pressure to the pressure member against the belt in a load direction. The releasable pressure is released as the pressure member moves away from the belt. The first guide member defines a first elongated opening extending in the load direction for displaceably accommodating a first longitudinal end of the pressure member therein. The second guide member defines a second elongated opening extending transversely to the load direction for displaceably accommodating a second longitudinal end, opposite the first longitudinal end, of the pressure member therein.

Other exemplary aspects of the present invention are put forward in view of the above-described circumstances, and provide a novel mechanism for guiding movement of a rotatable pressure member that applies a variable pressure against an opposed, rotatable fuser member in a load direction. The variable pressure varies as the pressure member moves relative to the fuser member.

In one exemplary embodiment, the mechanism includes a stationary guide member and a moveable guide member. The stationary guide member defines a first elongated opening extending in the load direction for displaceably accommodating a first longitudinal end of the pressure member therein. The moveable guide member defines a second elongated opening extending transversely to the load direction for displaceably accommodating a second longitudinal end, opposite the first longitudinal end, of the pressure member therein.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
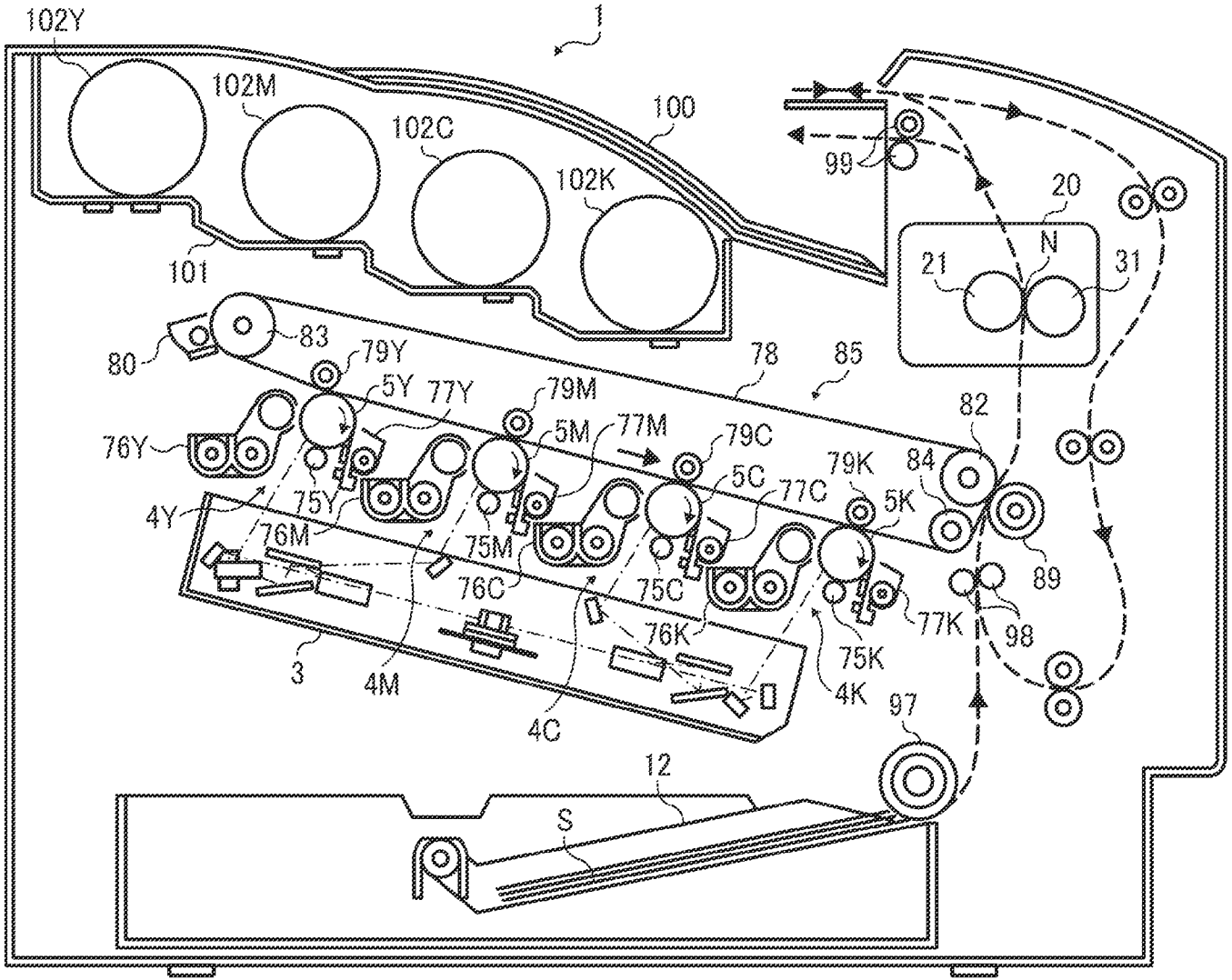
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one or more embodiments of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to an exposure unit 3, which together form an electrophotographic mechanism to form an image with toner particles on a recording medium such as a sheet of paper S, for subsequent processing through the fixing device 20 located above the intermediate transfer unit 85.

The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, and a discharging device, which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from detachably attached, replaceable toner bottles 102Y, 102M, 102C, and 102K, respectively, accommodated in a bottle rack 101 in the upper portion of the apparatus body.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form a fixing nip N therebetween in the sheet conveyance path. A detailed description of the fixing device 20 and its associated structure will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the exposure unit 3. The laser exposure selectively dissipates the charge on the photoconductive surface to form an electrostatic latent image thereon according to image data representing a particular primary color. Then, the latent image enters the development device 76, which renders the incoming image visible using toner.

The toner image thus obtained is forwarded to the primary transfer nip between the intermediate transfer belt 78 and the primary transfer roller 79.

At the primary transfer nip, the primary transfer roller 79 is supplied with a bias voltage of a polarity opposite that of the toner on the photoconductor drum 5. This electrostatically transfers the toner image from the photoconductive surface to an outer surface of the belt 78, with a certain small amount of residual toner particles left on the photoconductive surface. Such transfer process occurs sequentially at the four primary transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
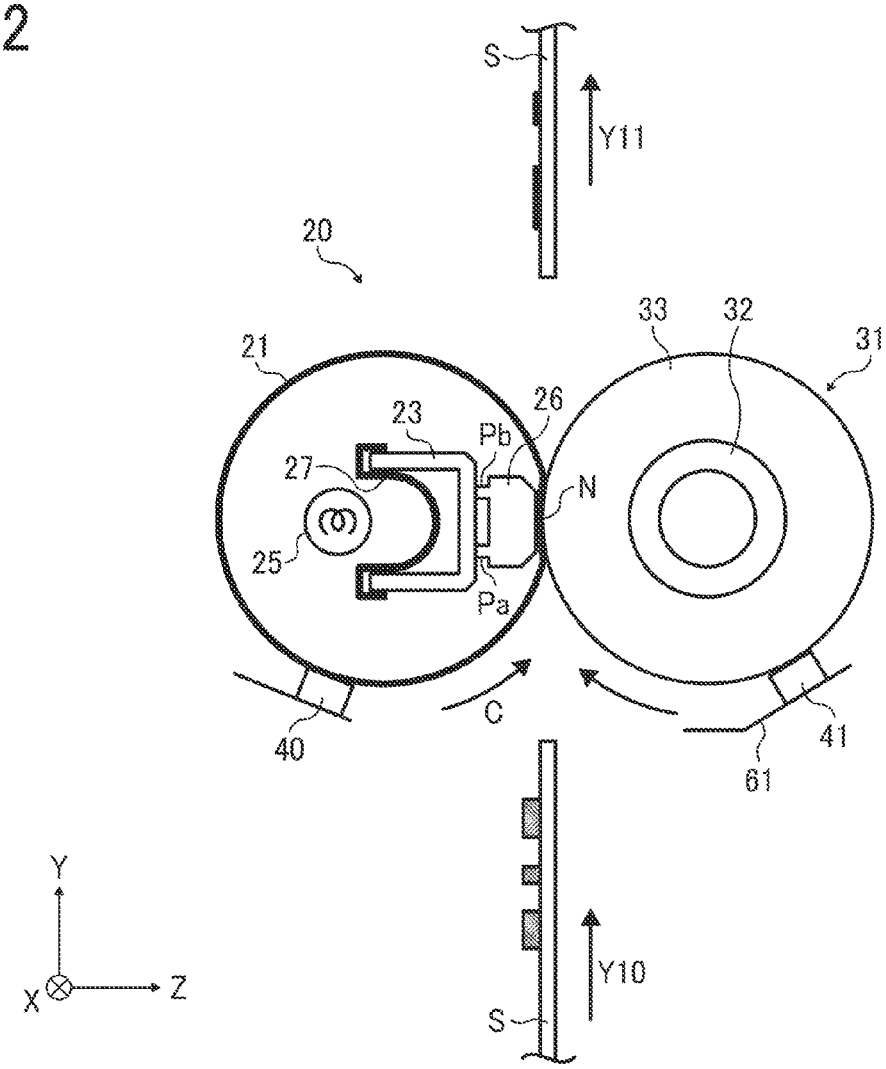
FIG. 2 is an axial cross-sectional view of the fixing device according to one embodiment of this patent specification.

FIG. 2 is an axial cross-sectional view of the fixing device 20 according to one embodiment of this patent specification.

As shown in FIG. 2, the fixing device 20 includes a rotatable, endless flexible fuser belt 21 looped into a generally cylindrical configuration extending in a longitudinal, axial direction X thereof for rotation in a rotational, circumferential direction C thereof; an elongated stationary fuser pad 26 stationarily disposed inside the loop of the belt 21; and a pressure roller 31 disposed parallel to the fuser pad 26 with the belt 21 interposed between the pressure roller 31 and the fuser pad 26. The pressure roller 31 presses against the fuser pad 26 via the belt 21 in a load direction Z to form a fixing nip N therebetween, through which a recording medium S is conveyed in a conveyance direction Y.

Also included in the fixing device 20 are a reinforcing member 23 stationarily disposed in contact with the fuser pad 26 inside the loop of the belt 21 for reinforcing the fuser pad 26; a heater 25 disposed adjacent to the belt 21 to heat the belt 21; a reflector 27 disposed on the reinforcing member 23 to reflect radiation from the heater 25; a first temperature sensor 40 disposed facing the belt 21 to detect temperature at the belt surface; and a second temperature sensor 41 disposed facing the pressure roller 31 to detect temperature at the roller surface.

Figure 3:
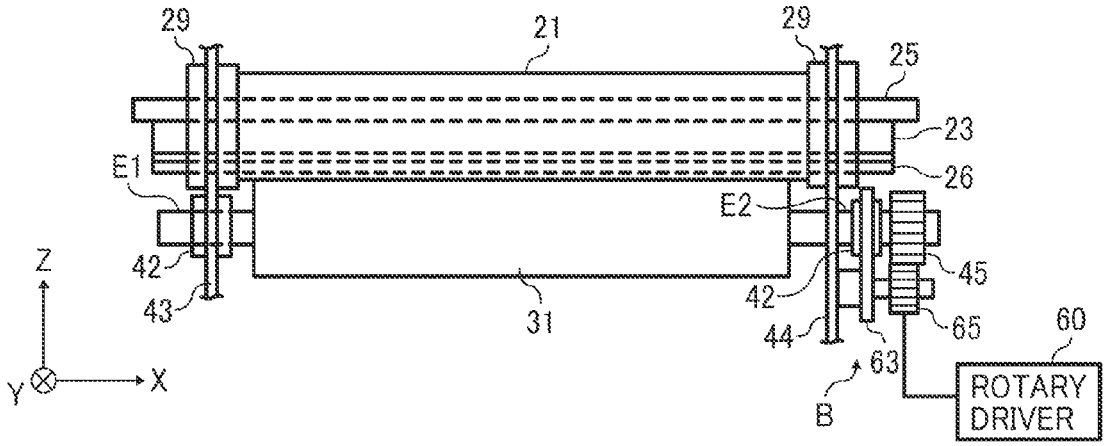
FIG. 3 is a side-on, lateral view of the fixing device of FIG. 2.

With additional reference to FIG. 3, which is a side-on, lateral view of the fixing device 20 of FIG. 2, components of the fixing device 20 are shown disposed between a pair of parallel, first and second sidewalls 43 and 44 defining a stationary enclosure in which the fixing device 20 is accommodated.

A pair of retaining flanges 29 is provided on the sidewalls 43 and 44, one connected to a longitudinal end of the looped belt 21, to retain the belt 21 in the generally cylindrical configuration thereof. In the present embodiment, the fuser belt 21 does not have any guide structure, such as a tubular holder of thermally conductive metal, or heat pipe, for guiding its inner circumferential surface therealong during rotation, except for the retaining flanges 29 retaining the belt 21 in shape at the longitudinal ends thereof, and the fuser pad 26 contacting the belt 21 along the fixing nip N.

Elongated components of the fixing device 20, such as, for example, the fuser belt 21, the fuser pad 26, the reinforcing member 23, the heater 25, and the pressure roller 31, extend generally in parallel with each other and have their respective longitudinal ends supported on the sidewalls 43 and 44 either directly or indirectly.

As used herein, the term "longitudinal direction X" refers to a direction in which the looped belt 21 extends in its generally cylindrical configuration. The term "circumferential direction C" refers to a direction along a circumference of the looped belt 21 in its generally cylindrical configuration. The term "conveyance direction Y" refers to a direction perpendicular to the longitudinal direction X, or more precisely, the direction tangential to the cylindrical configuration of the looped belt 21 at the fixing nip N, in which the recording medium S is conveyed along the fixing nip N, and which overlaps the circumferential direction C of the looped belt 21 at the fixing nip N. The term "load direction Z" refers to a direction perpendicular to the longitudinal direction X and the conveyance direction Y, in which the pressure member presses against the fuser pad 26 to establish the fixing nip N.

During operation, upon activation of the image forming apparatus 1, power supply circuitry starts supplying power to the heater 25, whereas a rotary drive motor activates the pressure roller 31 to rotate clockwise in the drawing, which in turn rotates the fuser belt 21 counterclockwise in the drawing due to friction between the belt and roller surfaces.

Then, a recording sheet S bearing an unfixed, powder toner image, which has been transferred through the secondary transfer nip, enters the fixing device 20 while guided along a suitable guide mechanism in the conveyance direction Y10. As the fuser belt 21 and the pressure roller 31 rotate together, the recording sheet S advances through the fixing nip N to fix the toner image in place, wherein heat from the fuser belt 21 causes the toner particles to fuse and melt, while pressure between the fuser pad 26 and the pressure roller 31 causes the molten toner to set onto the recording sheet S. Upon exiting the fixing nip N, the recording sheet S is forwarded to a subsequent destination in the conveyance direction Y11.

Figure 4:
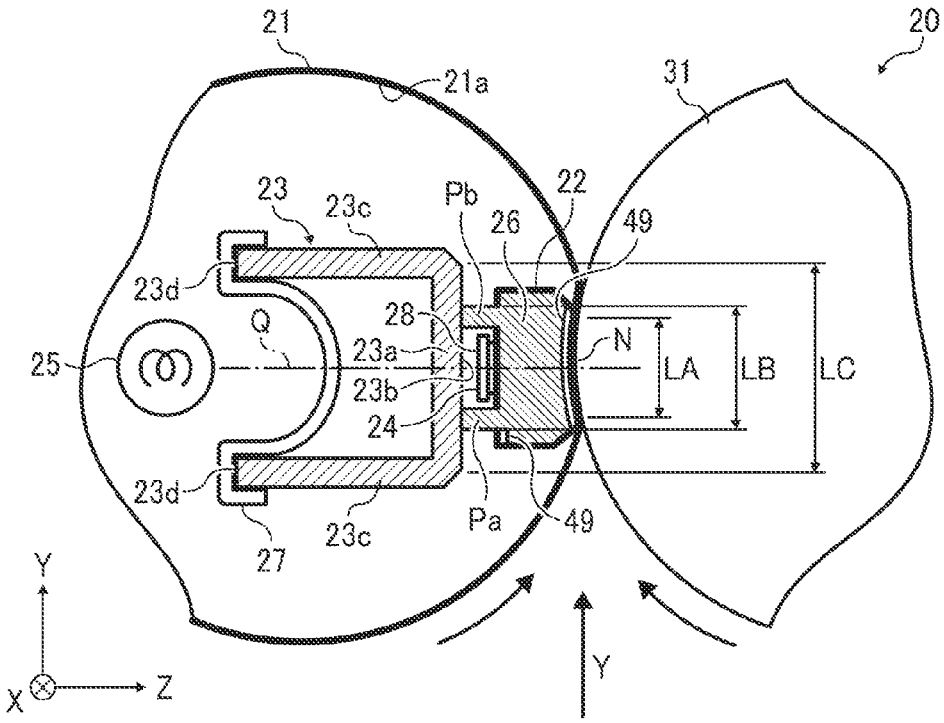
FIG. 4 is an enlarged view of the fixing device of FIG. 2.

With reference to FIG. 4, which is an enlarged view of the fixing device 20 of FIG. 2, the fixing assembly is shown further including a low-friction sheet 22 of lubricant-impregnated material covering the stationary fuser pad 26 to supply lubricant between the fuser pad 26 and the belt 21 across the fixing nip N, one or more screws 24 to fasten the low-friction sheet 22 onto the fuser pad 26, and a securing plate 28 disposed where the low-friction sheet 22 is screwed to secure the sheet 22 in place on the fuser pad 26.

Components inside the loop of the fuser belt 21, including the stationary pad 26, the low-friction sheet 22, the screws 24, and the securing plate 28, as well as the reinforcing member 23, the heater 25, and the reflector 27, are all stationarily disposed inside the loop of the fuser belt 21.

As used herein, the term "stationary" or "stationarily disposed" is used to describe a state in which a component, such as the fuser pad or the reinforcing member, remains still and do not move or rotate as the pressure roller and the fuser belt rotate during operation of the fixing device. Hence, a stationary member may still be subjected to external mechanical force and pressure resulting from its intended use (e.g., the stationary fuser pad pressed against the pressure member by a spring or biasing member), but only to an extent that does not cause substantial movement, rotation, or displacement of the stationary member.

Specifically, in the fixing device 20, the fuser belt 21 comprises a flexible, endless belt consisting of an inner, thermally conductive substrate defining an inner circumferential surface 21*a* (i.e., the surface that faces the fuser pad 26 inside the loop) of the belt 21, an intermediate elastic layer disposed on the substrate, and an outer release layer disposed on the intermediate elastic layer, which together form a multilayered structure with a thickness of approximately 1 mm or thinner. The belt 21 is looped into a generally cylindrical configuration, approximately 15 mm to approximately 120 mm in diameter. In the present embodiment, the fuser belt 21 is a multilayered endless belt having an inner diameter of approximately 30 mm in its looped, generally cylindrical configuration.

More specifically, the substrate of the belt 21 may be formed of thermally conductive material, approximately 30 μm to approximately 50 μm thick, including nickel, stainless, or any suitable metal, as well as synthetic resin such as polyimide (PI). The elastic layer of the belt 21 may be a deposit of rubber, such as solid or foamed silicone rubber, fluorine resin, or the like, approximately 100 μm to approximately 300 μm thick on the substrate. The outer release layer may be a deposit of a release agent, such as tetra fluoro ethylene-perfluoro alkylvinyl ether copolymer or PFA, polytetrafluoroethylene (PTFE), polyimide (PI), polyetherimide (PEI), polyethersulfide (PES), or the like, approximately 5 to 50 μm in thickness on the elastic layer.

The intermediate elastic layer serves to accommodate minute variations in applied pressure to maintain smoothness of the belt surface at the fixing nip N, which ensures uniform distribution of heat across the recording sheet S to yield a resulting print with a smooth, consistent appearance without artifacts, such as an orange peel-like texture. The release layer provides good stripping of toner from the belt surface to ensure the recording sheet S is properly conveyed through the fixing nip N.

Figure 5:
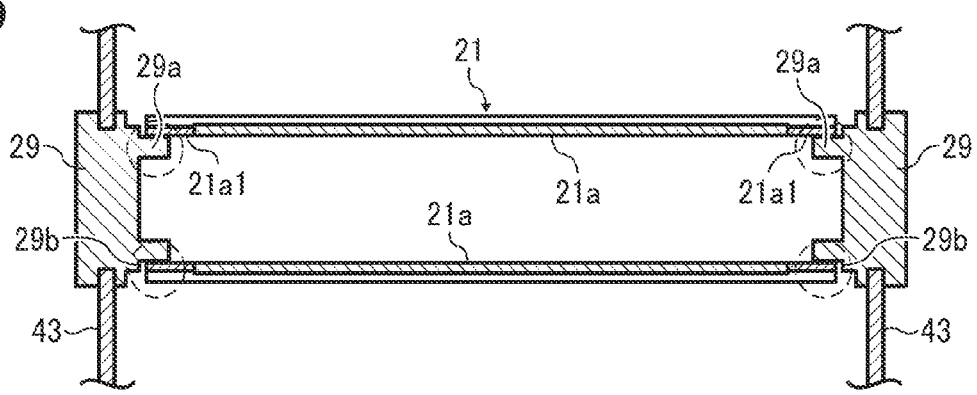
FIG. 5 is a lateral cross-sectional view of an endless belt assembly included in the fixing device of FIG. 2.

With additional reference to FIG. 5, which is a lateral cross-sectional view of the endless belt assembly included in the fixing device 20 of FIG. 2, the fuser belt 21 is shown having its opposed longitudinal ends rotatably supported on the pair of retaining flanges 29 mounted to the sidewalls 43 and 44.

The pair of retaining flanges 29 each comprises a piece of suitable material, such as heat-resistant plastic. The retaining flange 29 has a generally circular guide edge 29*a* around which the longitudinal end of the belt 21 is seated to keep the belt 21 in shape and position, and a recessed stopper edge 29*b* around the guide edge 29*a* facing the longitudinal end of the belt 21 to restrict lateral displacement or walk of the belt 21 in the longitudinal direction X thereof.

A pair of low-friction surfaces 21*a*1 may be provided on those portions of the belt 21 which slide along the guide edge 29*a* as the belt 21 rotates in the circumferential direction C thereof. Such low-friction surface 21*a*1 may be formed, for example, by depositing a coating of lubricant, such as fluorine resin or the like, on selected portions of the substrate of the belt 21, as indicated by dotted circles in FIG. 5. Provision of the low-friction surfaces 21*a*1 protects the fuser belt 21 and the guide edges 29*a* of the flange 29 against abrasion or deterioration due to sliding contact between the belt 21 and the guide edges 29*a* during rotation of the belt 21.

Optionally, to prevent damage from excessive abrasion between the longitudinal end of the belt 21 and the retaining flange 29, an annular slip ring, separate from the flange 29, may be provided around the stopper edge 29*b* of the flange 29. Such slip ring may be formed of a suitable low-friction, heat resistant material, such as polyether ether ketone (PEEK), polyphenylene sulfide (PPS), polyamide-imide (PAI), PTFE, or the like, which exhibits a sufficiently low coefficient of friction with respect to the belt material.

Assembled with the retaining flanges 29, the fuser belt 21 can maintain its looped, generally cylindrical configuration, while kept in its proper operational position spaced apart the reinforcing member 23 and the reflector 27 disposed inside the loop of the belt 21. To prevent interference between the fuser belt 21 and the adjacent structure even where the flexible belt 21 deforms at its longitudinal center during rotation, spacing between the belt 21 and each adjacent structure may be dimensioned depending on rigidity of the belt material. For example, a lower limit of such spacing may be set to approximately 0.02 mm where the belt material is relatively rigid and to approximately 3 mm where the belt material is relatively soft.

With continued reference to FIG. 4, the heater 25 is shown configured as a radiant heater, such as a halogen heater or a carbon heater, disposed inside the loop of the belt 21 to radiate heat to the belt 21. For example, the heater 25 may be an elongated halogen heater having a pair of longitudinal ends thereof secured to the sidewalls 43 and 44 of the fixing device 20. Although a single heater is used in the present embodiment, the heater 25 may be configured otherwise than disclosed herein, and multiple heating elements may be disposed inside the loop of the belt 21.

During operation, the heater 25 radiates heat to the entire length of the belt 21 except at the fixing nip N, such that the belt 21 conducts heat to the toner image T on the recording sheet S passing through the fixing nip N. Operation of the heater 25 is electrically controlled, for example, through on-off control based on readings of the temperature sensor 40, such as a thermometer, a thermistor, a thermopile, or the like, disposed facing or in contact with an outer circumferential surface of the belt 21 to detect the belt temperature, so as to adjust the belt temperature to a desired fixing temperature.

Heating the belt 21 from inside the belt loop allows for an energy-efficient, fast compact fixing process that can print with short warm-up time and first-print time without requiring a complicated or expensive heating assembly. That is, compared to radiation directed to a local, limited area of the belt, radiation from the heater 25 can simultaneously reach a relatively large area along the circumference of the belt 21, resulting in a sufficient amount of heat imparted to the belt 21 to prevent image defects even at high processing speeds. In particular, compared to a configuration in which the fuser belt is indirectly heated through conduction from a heat pipe, direct radiant heating of the belt 21 with the heater 25 allows for a higher energy efficiency, leading to a compact, low-cost configuration of the belt-based fixing device.

The fuser pad 26 comprises an elongated piece of sufficiently rigid material having its opposed longitudinal ends supported on the pair of retaining flanges 29 mounted to the sidewalls 43 and 44. Examples of suitable material for the fuser pad 26 include metal or resin, in particular, heat-resistant, thermally insulative resin, such as liquid crystal polymer (LCP), PAI, polyethersulfone (PES), PPS, polyether nitrile (PEN), PEEK, or the like, which does not substantially bend or deform under pressure from the pressure roller 31 during operation. In the present embodiment, the fuser pad 26 is formed of LCP.

The fuser pad 26 has a smooth, slidable contact surface defined on its front side to face the pressure roller 31. In this embodiment, the slidable contact surface of the fuser pad 26 is slightly concave with a curvature similar to that of the circumference of the pressure roller 31. Such a configuration allows the contact surface to conform readily to the circumferential surface of the pressure roller 31, which prevents the recording sheet S from adhering to or winding around the fuser belt 21 upon exiting the fixing nip N, leading to reliable conveyance of the recording sheet S after fixing process.

Alternatively, instead of the curved configuration, the slidable contact surface of the fuser pad 26 may be substantially flat. Such a flat contact surface remains parallel to the recording sheet S entering the fixing nip N, causing the printed surface of the sheet S to remain flat and thus closely contact the fuser belt 21, leading to good fixing performance through the fixing nip N. Flattening the contact surface also facilitates ready stripping of the recording sheet S from the fuser belt 21, as it causes the flexible belt 21 to exhibit a curvature larger at the exit of the fixing nip N than within the fixing nip N.

The reinforcing member 23 comprises an elongated stay of rigid material having a length substantially identical to that of the fuser pad 26. The reinforcing member 23 supports the fuser pad 26 against pressure from the pressure roller 31 transmitted via the fuser belt 21, thereby protecting the fuser pad 26 from substantial bowing or deformation due to nip pressure. For providing sufficient reinforcement, the reinforcing member 23 may be formed of mechanically strong metal, such as stainless steel, iron, or the like.

In the present embodiment, the reinforcing member 23 has a rectangular U-shaped axial cross-section, consisting of a center wall 23*a* defining a flat bearing surface 23*b* to contact the fuser pad 26, and a pair of parallel upstanding walls 23*c*, each extending perpendicular from the center wall 23*a* and having a free, distal edge 23*d* thereof pointing away from the center wall 23*a*. The reinforcing member 23 is disposed stationarily inside the loop of the belt 21, with the hearing surface 23*b* in contact with the fuser pad 26, and the distal edges 23*d* directed toward the heater 25, and is secured in position against the fuser pad 26 by having its longitudinal ends supported on the retaining flanges 29 at the longitudinal ends of the fuser assembly.

Figure 6:
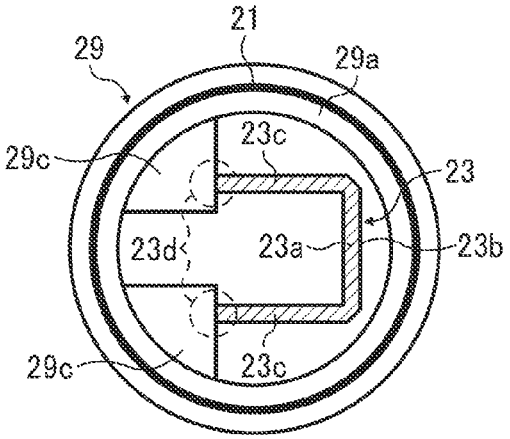
FIG. 6 is an end-on, axial partially cross-sectional view of the endless belt assembly of FIG. 5.

With additional reference to FIG. 6, which is an end-on, axial partially cross-sectional view of the endless belt assembly included in the fixing device 20 of FIG. 2, the reinforcing member 23 is shown with the distal edges 23*d* of the upstanding walls 23*c* each seated on ribs 29*c* of the retaining flange 29. Alternatively, instead of the distal edges 23*d* contacting the ribs 29*c*, the reinforcing member 23 may be positioned through direct contact with the sidewalls 43 and 44 of the fixing device 20.

The reflector 27 comprises a plate of reflective material disposed stationarily on that side of the reinforcing member 23 facing the heater 25. Examples of suitable material for the reflector 27 include aluminum, stainless steel, and the like.

Provision of the reflective surface on the reinforcing member 23 allows for a high efficiency in heating the belt 21 with the radiant heater 25, as it directs incoming radiation from the heater 25 toward the inner circumferential surface 21*a* of the belt 21 instead of the reinforcing member 23, resulting in an increased amount of heat absorbed in the belt 21. Alternatively, instead of providing a reflective element separate from the reinforcing member 23, the reinforcing member 23 may be treated with mirror polish or insulation coating, either partially or entirely, to prevent heat from being absorbed in the reinforcing member 23, which in turn allows for increased absorption of heat into the belt 21.

As mentioned earlier, the fixing device 20 in the present embodiment employs a radiant heater disposed inside the loop of the fuser belt 21 to radiate heat to a relatively large area of the inner circumferential surface 21*a* of the belt 21. Such radiant heating of the belt distributes heat along the entire circumference of the belt 21 even where the belt 21 does not rotate. With the belt 21 thus heated thoroughly and uniformly during standby, the fixing device 20 can immediately process an incoming print job upon recovery from standby.

One problem encountered by a conventional on-demand fixing device is that radiant heating the fuser belt can cause an excessive amount of heat accumulating in the pressure roller during standby. Depending on the material of the pressure roller, typically a rubber-based cylinder, intense heating of the pressure roller results in accelerated aging of the pressure roller due to thermal degradation, or more seriously, compression set of rubber under nip pressure, that is, permanent deformation of the rubber-based roller away from the fuser pad, which is aggravated by heat at the fixing nip. Such permanent deformation of the pressure roller translates into variations in size and strength of the fixing nip, which would adversely affect fixing performance, or cause abnormal noise during rotation of the fixing members.

To address these and other problems, in the present embodiment, the reinforcing member 23 together with the reflector 27 are positioned between the fuser pad 26 and the heater 25 to isolate the fuser pad 26 from radiation from the heater 25 inside the loop of the fuser belt 21.

Specifically, isolating the fuser pad 26 from heat radiation in turn protects the pressure roller 31 against excessive heating, which would otherwise cause the pressure roller 31 to develop permanent deformation at the fixing nip N where the rubber-based roller is subjected to pressure and heat during standby.

In addition, isolating the fuser pad 26 from heat radiation also isolates lubricant between the fuser pad 26 and the fuser belt 21 against continuous, intense heating, which would otherwise cause lubricant to degrade due to heat combined with high pressure at the fixing nip N, leading to slip or other disturbed movement of the belt along the fuser pad.

Moreover, isolating the fuser pad 26 from heat radiation prevents an excessive amount of heat from being applied to the fuser belt 21 at the fixing nip N, resulting in immediate cooling of the recording sheet S upon exiting the fixing nip N. As the recording sheet S cools, the toner image on the recording sheet S becomes less viscous and less adhesive to the fuser belt 21 at the exit of the fixing nip N. Reduced adhesion of the toner image to the fuser belt 21 allows the recording sheet S to readily separate from the fuser belt 21 without winding around or jamming the fixing nip N, while preventing built-up of toner residues on the surface of the fuser belt 21.

With specific reference to FIG. 4, the fixing device 20 is shown including the low-friction sheet 22 of lubricant-impregnated material covering the stationary pad 26 to supply lubricant between the stationary pad 26 and the belt 21 across the nip N.

During operation, the low-friction sheet 22 retains a constant, continuous supply of lubricant between the adjoining surfaces of the fuser pad 26 and the fuser belt 21, which protects the fuser pad 26 and the belt 21 against wear and tear due to abrasive, frictional contact between the pad and belt surfaces.

The material of the low-friction sheet 22 may be a web of fluorine resin, such as PTFE, which exhibits specific fabric properties, such as weave pattern, thread count, density, and the like. The thickness of the low-friction sheet 22 may fall in a range from approximately 150 to approximately 500 μm. The low-friction sheet 22 may be impregnated with a lubricating agent, such as silicone oil, which exhibits a kinematic viscosity ranging from approximately 50 to approximately 1,000 centistokes (cSt).

Use of resin-based woven material promotes retention of lubricant in the lubrication sheet 22 as it provides a porous, fibrous structure within which the lubricating agent may be stably accommodated. Moreover, should the lubrication sheet 22 be depleted of lubricant, the low-friction, fluorine resin material does not cause a substantial frictional resistance at the interface between the fuser pad 26 and the fuser belt 21.

The low-friction sheet 22 may be bonded to selected portions of the fuser pad 26, including, for example, a front side defining the fixing nip N and an edge or surface positioned upstream relative to a center of the fixing nip N in the conveyance direction Y (that is, the lower portion of the fuser pad in FIG. 4). Bonding the low-friction sheet 22 may be accomplished, for example, using a double-sided adhesive tape 49 extending across a length of the sheet 22 in the longitudinal direction X. Such arrangement securely prevents the low-friction sheet 22 from separating from the fuser pad 26 as the fuser pad 21 rotates from downstream to upstream in the circumferential direction C thereof during operation.

With continued reference to FIG. 4, the low-friction sheet 22 in the present embodiment is shown wrapping around the stationary pad 26, such that the low-friction sheet 22 covers an entire surface of the fuser pad 26 except where the pad 26 contacts the reinforcing member 23.

Specifically, in the present embodiment, the stationary fuser pad 26 includes one or more contact portions P spaced apart from each other in the conveyance direction Y, each generally extending in the longitudinal direction X of the belt 21 and protruding toward the reinforcing member 23 to contact the reinforcing member 23. The low-friction sheet 22 has at least one perforation 22*a* defined therein through which the contact portions P are inserted to allow close fitting between the low-friction sheet 22 and the stationary pad 26 except at the contact portions P.

More specifically, in the present embodiment, the stationary pad 26 includes a pair of contact portions Pa and Pb, one positioned upstream and the other downstream from a center of the stationary pad 26 in the conveyance direction Y. Each of the upstream and downstream contact portions Pa and Pb defines a generally flat contact surface to establish surface contact with the bearing surface 23*b* of the reinforcing member 23.

Provision of the mutually spaced contact portions P allows for stable positioning of the stationary fuser pad 26 even where the fuser pad 26 is not equipped with a solid, sturdy retaining structure, such as one implemented in a tubular belt holder or heat pipe that has a longitudinal side slot for accommodating the fuser pad therein.

Consider a configuration in which the fuser pad has substantially no retaining structure, while provided with only a single contact portion to contact the reinforcing member. In general, such a contact portion is dimensioned substantially narrower than the width of the pad in the conveyance direction, or otherwise, is offset from the center of the pad in the conveyance direction. In such cases, without any retaining structure, the fuser pad is susceptible to displacement from its proper operational position where pressure from the pressure roller forces the fuser pad to tilt or pivot about the contact portion, resulting in dimensional variations in the fixing nip and concomitant failures, such as defective fixing performance and faulty conveyance of recording media through the fixing nip.

By contrast, the fuser pad 26 in the present embodiment can remain stable and secure in position. That is, the fuser pad 26 does not tilt or pivot around each contact portion P even when subjected to nip pressure, since the multiple mutually spaced contact portions P, encompassing a relatively large area across the fuser pad 26 in the conveyance direction Y, promotes even, uniform contact between the fuser pad 26 and the reinforcing member 23 while effectively dispersing external forces acting on the fuser pad 23 during operation. Well-balanced positioning of the fuser pad 26 may be obtained particularly where the pair of contact portions Pa and Pb is provided, one positioned upstream and the other downstream from a center of the stationary pad 26 in the conveyance direction Y, as is the case with the present embodiment.

Moreover, provision of the mutually spaced contact portions P allows for high thermal efficiency in the fuser assembly, as it can reduce a total area of contact between the fuser pad 26 and the reinforcing member 23, compared to that necessary where the fuser pad has a single continuous contact surface to contact the reinforcing member. A reduction in the contact area between the fuser pad 26 and the reinforcing member 23 translates into a reduced amount of heat escaping from the fuser belt 21 to the reinforcing member 23 via the fuser pad 26, leading to increased thermal efficiency in the fuser assembly. This is particularly true where the fuser belt 21 readily loses substantial heat through conduction to the fuser pad 26, for example, due to the fuser belt 21 being of a relatively thin substrate (such as one with a thickness on the order of 160 μm or less), or due to the fixing nip N having a relatively large width in the conveyance direction Y.

Figure 7A:
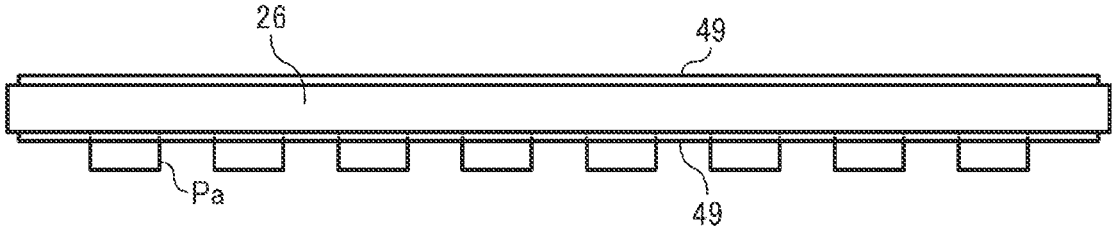
FIGS. 7A, 7B, and 7C are side-elevation, rear-plan, and front-plan views, respectively, of a stationary pad before assembly into the fixing device of FIG. 2.
Figure 7B:
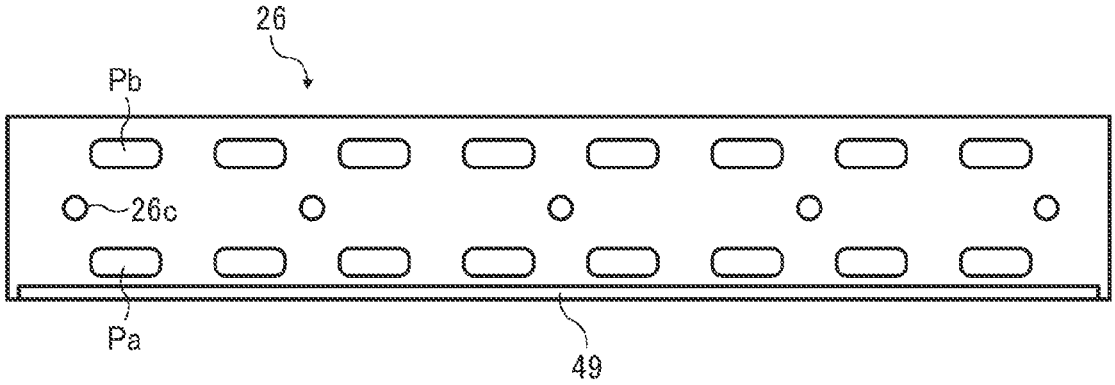
Figure 7C:
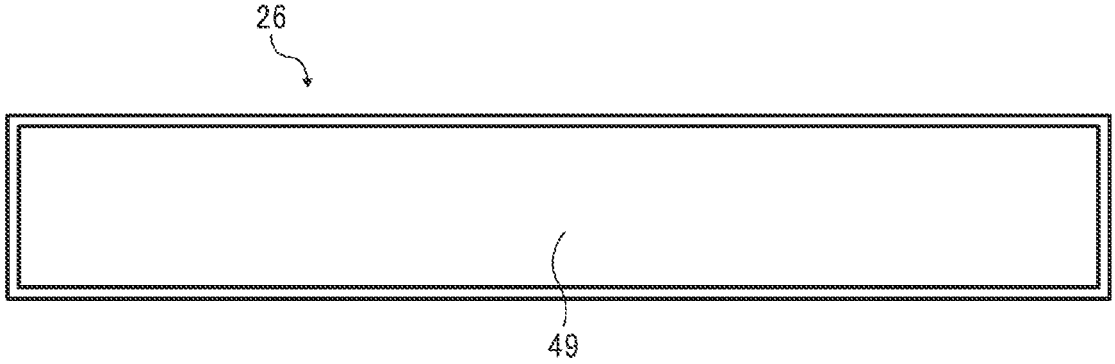

FIGS. 7A, 7B, and 7C are side-elevation, rear-plan, and front-plan views, respectively, of the stationary pad 26 before assembly into the fixing device 20 of FIG. 2.

As shown in FIGS. 7A and 7B, each of the contact portions Pa and Pb of the fuser pad 26 includes a series of mutually spaced protrusions arranged in the longitudinal direction X of the belt 21.

Specifically, in the present embodiment, each of the upstream and downstream contact portions Pa and Pb includes a plurality of (in this case, eight) protrusions in series, each evenly spaced from each other in the longitudinal direction X while aligned with a corresponding one of the protrusions on the other side of the fuser pad 26. Compared to providing each contact portion in a single, elongated continuous shape, provision of the series of mutually spaced protrusions results in a reduced area of contact between the fuser pad 26 and the reinforcing member 23, leading to higher thermal efficiency in the fuser assembly.

Although in the present embodiment, the fuser pad 26 is depicted as including two series of mutually spaced protrusions to contact the reinforcing member 23, the contact portions P may be configured otherwise than those depicted herein. For example, instead of a flat contact surface, the contact portion P may define a linear contact edge or a pointed contact end to establish line or point contact (or any such similar contact) with the bearing surface 23*b* of the reinforcing member 23. Further, the number of contact portions P is not limited to two, and three or more contact portions P spaced apart from each other in the conveyance direction Y may be provided depending on specific applications.

With still continued reference to FIG. 4, the stationary fuser pad 26 is shown being symmetrical in cross section with respect to an imaginary plane Q perpendicular to the conveyance direction Y and passing through a center of the fuser pad 26 in the conveyance direction Y, as indicated by a broken line in FIG. 4.

Symmetrical configuration of the fuser pad 26 allows for increased balance and stability in position of the fuser pad 26, leading to higher protection against displacement of the fuser pad 26 and concomitant adverse effects on fixing and media conveyance performance of the fixing device.

Further, in the conveyance direction Y, the contact portions P of the fuser pad 26 are dimensioned with respect to the adjacent structure of the fuser assembly to satisfy the following inequality:

$$LA<LB<LC \qquad \text{Equation I}$$

where "LA" indicates a length or distance between two furthest edges of the fixing nip N in the conveyance direction Y, "LB" indicates a length or distance between two furthest edges of the upstream and downstream contact portions Pa and Pb in the conveyance direction Y, and "LC" indicates a length or distance between two furthest edges of the bearing surface 23*b* in the conveyance direction Y.

Furthermore, in the conveyance direction Y, the two furthest edges of the fixing nip N both exist between the two furthest edges of the contact portions Pa and Pb, both of which in turn exist between the two furthest edges of the bearing surface 23*b* of the reinforcing member 23. Thus, in the conveyance direction Y, the dimension of the fixing nip N is encompassed by that of the multiple, mutually spaced contact portions P, which is in turn covered by the dimension of the bearing surface 23*b* of the reinforcing member 23.

Such dimensioning of the contact portions P with respect to the adjacent structure of the fuser assembly allows for increased balance and stability in position of the fuser pad 26, leading to higher protection against displacement of the fuser pad 26 and concomitant adverse effects on fixing and media conveyance performance of the fixing device.

Figure 8:
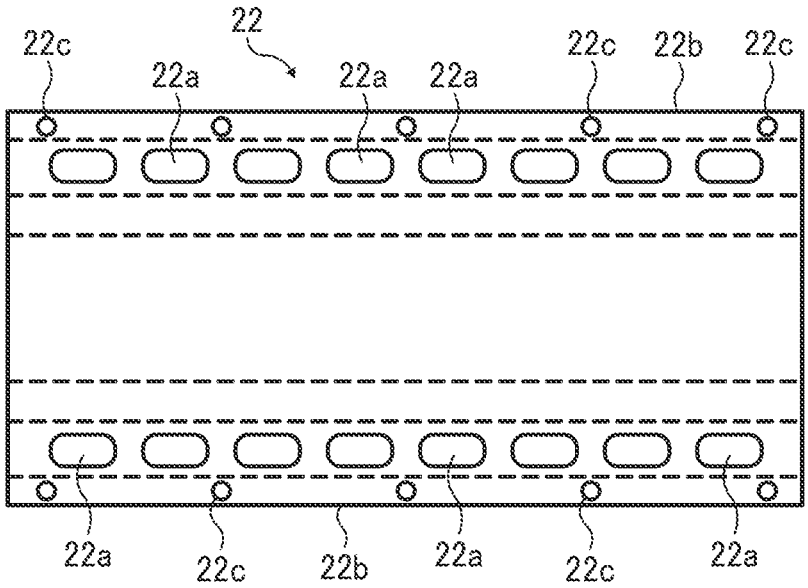
FIG. 8 is a plan view of a low-friction sheet in its unfolded, disassembled state before assembly into the fixing device of FIG. 2.

FIG. 8 is a plan view of the low-friction sheet 22 in its unfolded, disassembled state before assembly into the fixing device 20 of FIG. 2.

As shown in FIG. 8, in the present embodiment, the low-friction sheet 22 comprises a generally rectangular piece extending in the longitudinal direction X, which has a pair of opposed, longitudinal edges 22*b* thereof overlapping each other as the low-friction sheet 22 wraps around the stationary pad 26. The low-friction sheet 22 has one or more (e.g., in this case, five) pairs of screw holes 22*c* defined in the pair of opposed, longitudinal edges 22*b* thereof, each paired screw holes being aligned with each other upon wrapping of the low-friction sheet 22 around the stationary pad 26.

Also, as mentioned earlier, one or more perforations 22*a* are defined in the low-friction sheet 22 through which the contact portions P are inserted to allow close fitting between the low-friction sheet 22 and the stationary fuser pad 26 except at the contact portions P. For example, two series of eight oval perforations 22*a* may be provided, each perforation adapted to accommodate a single protrusion included in the pair of contact portions Pa and Pb of the fuser pad 26.

Figure 9:
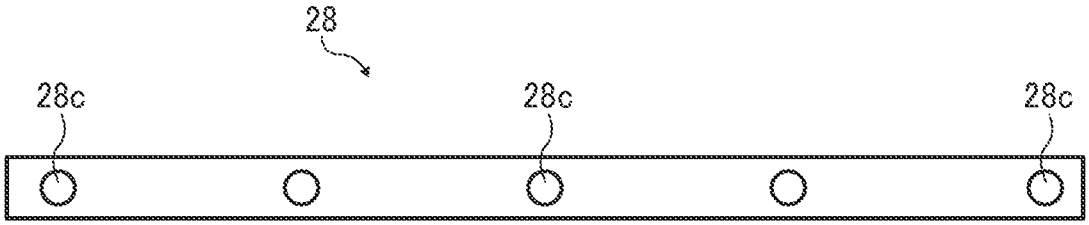
FIG. 9 is a plan view of a securing plate before assembly into the fixing device of FIG. 2.

FIG. 9 is a plan view of the securing plate 28 before assembly into the fixing device 20 of FIG. 2.

As shown in FIG. 9, in the present embodiment, the securing plate 28 is a flat, elongated piece of suitable material having a length comparable to that of the fuser pad 26. The securing plate 28 has one or more (e.g., in this case, five) screw holes 28*c* defined therein to allow insertion of screws 24 therethrough.

Figure 10A:
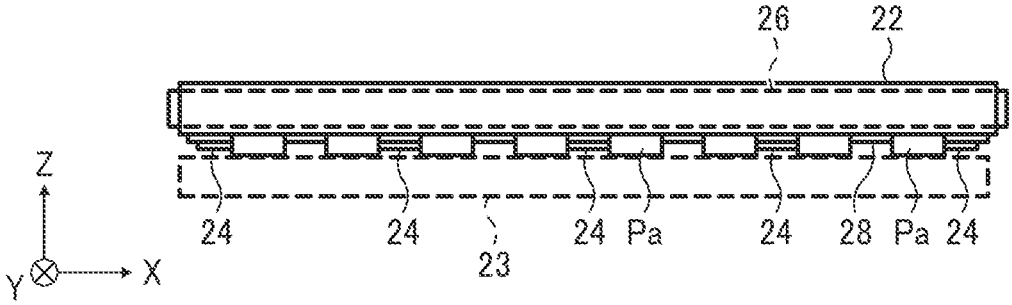
FIGS. 10A and 10B are side-elevation and plan views, respectively, of the stationary pad assembled together with the low-friction sheet and the securing plate.
Figure 10B:
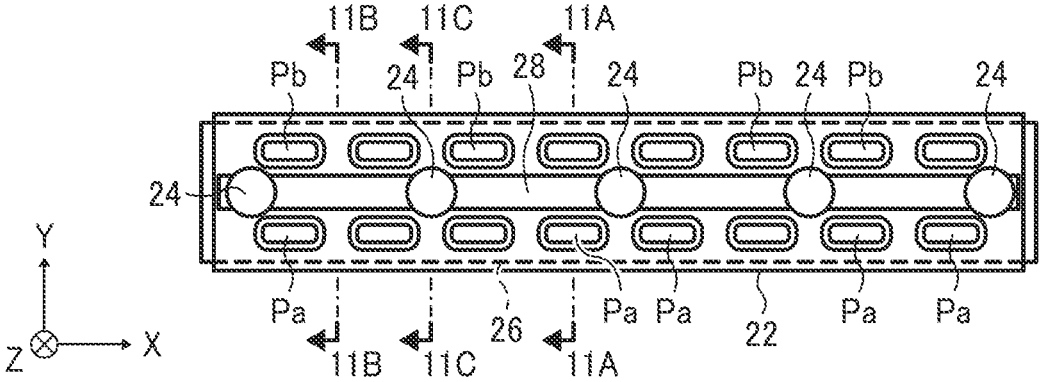

FIGS. 10A and 10B are side-elevation and plan views, respectively, of the stationary fuser pad 26 assembled together with the low-friction sheet 22 and the securing plate 28.

As shown in FIGS. 10A and 10B, in the present embodiment, one or more (e.g., in this case, five) screws 24 are provided for fastening the low-friction sheet 22 onto the stationary pad 26, each screw 24 evenly spaced apart from each other in the longitudinal direction X of the fuser pad 26. To accommodate these screws 24, the same number of screw holes may be provided at corresponding locations along each of the longitudinal edge 22*b* of the low-friction sheet 22 and the securing plate 28. Also, the same number of female threads 26*c* may be provided in the fuser pad 26, each adapted for engagement with a threaded end of the screw 24 (see FIG. 7B, for example).

Upon assembly, each of the one or more screws 24 passes through the aligned screw holes of the low-friction sheet 22 into the stationary pad 26 to fasten the sheet 22 onto the stationary pad 26. The securing plate 28 is disposed over the overlapping edges 22*b* of the low-friction sheet 22, and screwed onto the fuser pad 26 together with the sheet 22 to secure the sheet 22 in place on the fuser pad 26.

The fuser pad 26, the low-friction sheet 22, the securing plate 28, and the screws 24 are thus combined together to form a single, integrated subassembly module for mounting to the fixing device 20.

Figure 11A:
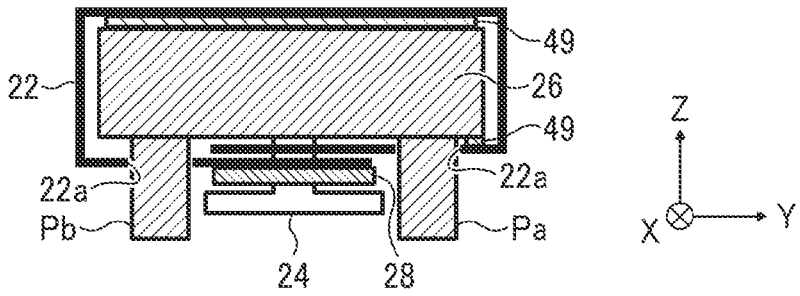
FIGS. 11A, 11B, and 11C are cross-sectional views along lines 11A-11A, 11B-11B, and 11C-11C, respectively, of FIG. 10B.
Figure 11B:
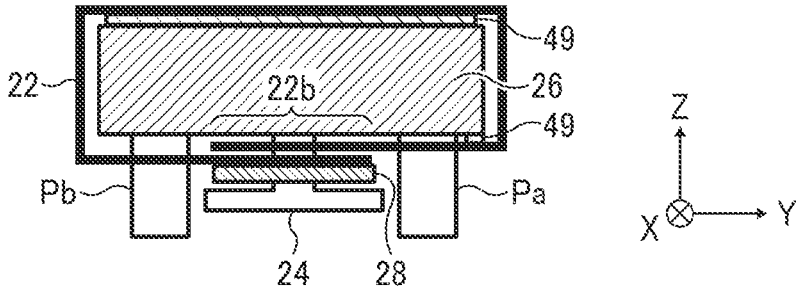
Figure 11C:
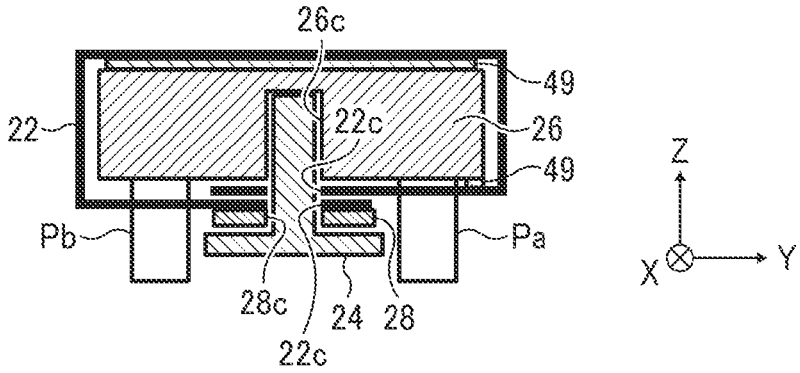

FIGS. 11A, 11B, and 11C are cross-sectional views along lines 11A-11A, 11B-11B, and 11C-11C, respectively, of FIG. 10B.

As shown in FIGS. 11A through 11C, in the fuser assembly, the low-friction sheet 22 wraps around the fuser pad 26 except for the contact portions Pa and Ph protruding through the perforations 22*a* defined in the sheet 22 (FIG. 11A).

The pair of opposed longitudinal edges 22*b* of the low-friction sheet 22 overlaps each other at a position between the upstream and downstream contact portions Pa and Pb, with the securing plate 28 disposed over the overlapping edges 22*b* of the sheet 22 (FIG. 11B).

The screw 24 is inserted through the screw hole 28*c* of the securing plate 28 and the paired screw holes 22*c* of the low-friction sheet 22, to engage the female thread 26*c* defined in the fuser pad 26 (FIG. 11C). For preventing interference between the screw 24 and the reinforcing member 23, the screw head is suitably sized or positioned so as not to protrude beyond the contact portions P in the load direction Z.

Thus, the low-friction sheet 22 has its opposed longitudinal edges 22*b*, one directed upstream and the other downstream in the conveyance direction Y, both fastened onto the fuser pad 26 with the screws 24. Such arrangement effectively protects the sheet 22 against displacement or separation from the fuser pad 26 as well as creasing and other deformation from its proper configuration due to frictional contact with the fuser belt 21, which would otherwise occur, for example, where the fuser belt 21 moves from upstream to downstream in the rotational direction C during normal operation of the fixing device 20, or where the fuser belt 21 moves from downstream to upstream in the rotational direction C as the fuser member and/or the pressure member are manually rotated during maintenance or repair, such as removal of a paper jam, of the fixing device 20.

Moreover, using the evenly spaced screws 24 in combination with the securing plate 28 disposed on the overlapping edges of the sheet 22 can fasten the low-friction sheet 22 onto the fuser pad 26 more stably and firmly than other types of fastening mechanism, such as bonding the overlapping edges together using adhesive, or hooking the overlapping edges onto the contact portions.

Further, perforating the low-friction sheet 22 for accommodating the contact portions P while positioning the screws 24 and the securing plate 28 between the contact portions P allows for a compact overall size of the fuser assembly.

Still further, integrability of the fuser pad 26 together with the low-friction sheet 22 and the associated fastener and securing mechanism into an integrated subassembly module allows for good controllability and efficient assembly during manufacture and maintenance of the fixing device 20.

Furthermore, evenly spacing the series of protrusions constituting the contact portion P of the fuser pad 26 translates into even distribution of forces acting on the perforations 22*a* of the low-friction sheet 22, which prevents the sheet 22 from damage due to concentrated stress as the sheet 22 slides against adjoining surfaces during operation.

Referring back to FIGS. 2 and 3, the pressure roller 31 is shown comprising a motor-driven, elastically biased cylindrical body formed of a hollowed core 32 of metal, covered with an elastic layer 33 of thermally insulating material, such as sponged or solid silicone rubber, fluorine rubber, or the like. An additional, thin outer layer of release agent, such as PFA, P or the like, may be deposited over the elastic layer 33. Optionally, the pressure roller 31 may have a dedicated heater, such as a halogen heater, accommodated in the hollow interior of the metal core 32.

With the pressure roller 31 formed with the elastic layer 33, the fuser pad 26 is effectively protected against overload as the elastic material absorbs extra pressure applied to the fuser pad 26 from the pressure roller 31. Also, forming the elastic layer 33 of thermally insulative material reduces heat conduction from the fuser belt 21 toward the pressure roller 31, leading to high thermal efficiency in heating the fuser belt 21.

In the present embodiment, the pressure roller 31 has a diameter of approximately 30 mm, which is comparable to that of the fuser belt 21 in its looped, generally cylindrical configuration. Although the fuser belt 21 and the pressure roller 31 are of a similar diameter in the present embodiment, instead, it is possible to provide the generally cylindrical fixing members 21 and 31 with different diameters. For example, it is possible to form the fuser belt 21 with a diameter smaller than that of the pressure roller 31, so that the fuser belt 21 exhibits a greater curvature than that of the pressure roller 31 at the fixing nip N, which effects good stripping of a recording sheet from the fuser belt 21 upon exiting the fixing nip N.

As mentioned earlier, in the present embodiment, the second temperature sensor 41 is disposed adjacent to the pressure roller 31 to measure a temperature of the pressure roller 31.

For example, the temperature sensor 41 may be a thermometer or thermistor disposed in contact with the circumferential surface of the pressure roller 31. A cantilevered, leaf spring 61 is provided, having its one end secured to the enclosure of the fixing device 20, and another, free end connected to the temperature sensor 41 to elastically support the temperature sensor 41 in place with respect to the pressure roller 31.

Readings of the second temperature sensor 41 may be used to control operation of the fixing device 20 and its associated imaging processes. For example, printing may be suspended where the temperature sensor 41 detects a surface temperature of the pressure roller 31 falling below a predetermined temperature limit. Further, in a configuration in which the pressure roller 31 has a dedicated heater, operation of the heater may be electrically controlled, for example, through on-off control based on readings of the second temperature sensor 41.

With continued reference to FIG. 3, the pressure roller 31 is shown having a shaft extending from the roller body at opposed, first and second longitudinal ends E1 and E2 of the pressure roller 31. A rotary driver 60 is operatively connected with the pressure roller 31 to impart torque to the pressure roller 31. A releasable biasing mechanism B is operatively connected with the pressure roller 31 to apply a variable, releasable pressure to the pressure roller 31 against the belt 21 in the load direction Z perpendicular to the longitudinal direction X.

The releasable biasing mechanism B includes a rotatable positioning lever 63 provided to the second longitudinal end E2 of the pressure roller 31, which, when rotated, allows movement of the pressure roller 31 relative to the fuser belt 21 to vary the pressure between the pressure roller 31 and the belt 21. A pair of bearings 42 is provided around the shaft at the opposed longitudinal ends E1 and E2 of the pressure roller 31, one rotatably connecting the first longitudinal end E1 to the first sidewall 43, and the other rotatably connecting the second longitudinal end E2 to the positioning lever 63, which is in turn mounted to the second sidewall 44.

It is to be noted that, although the releasable biasing mechanism B in the present embodiment is provided to the second longitudinal end E2 of the pressure roller 31, the mechanism B may instead be provided to both the first and second longitudinal ends E1 and E2 of the pressure roller 31, in which case the pressure roller 31 may be positioned relative to the fuser belt 21 while keeping the roller 31 in proper, balanced alignment with the belt 21 in the longitudinal direction X.

Figure 12:
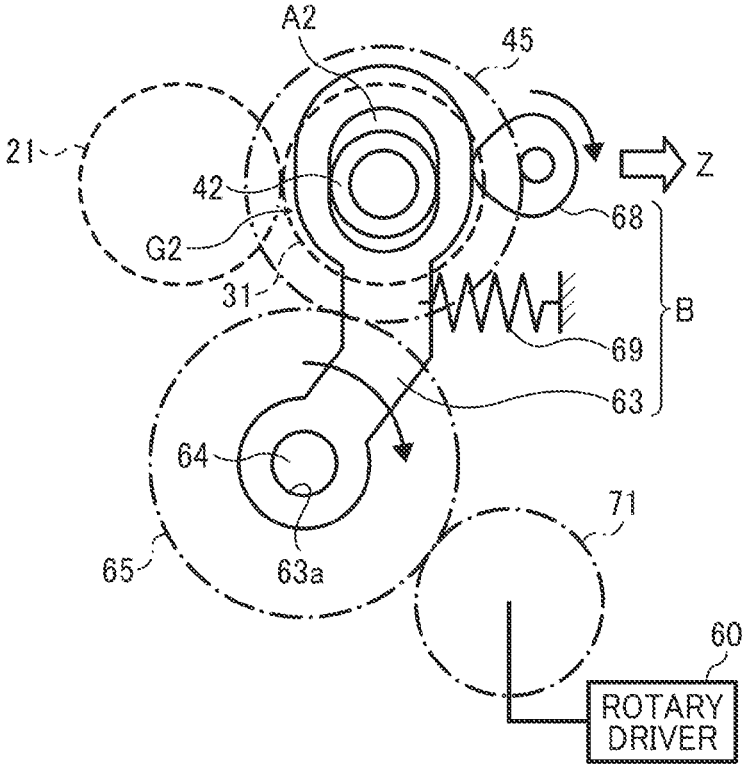
FIG. 12 is an end-on elevational view of the fixing device according to one embodiment of this patent specification.
Figure 13:
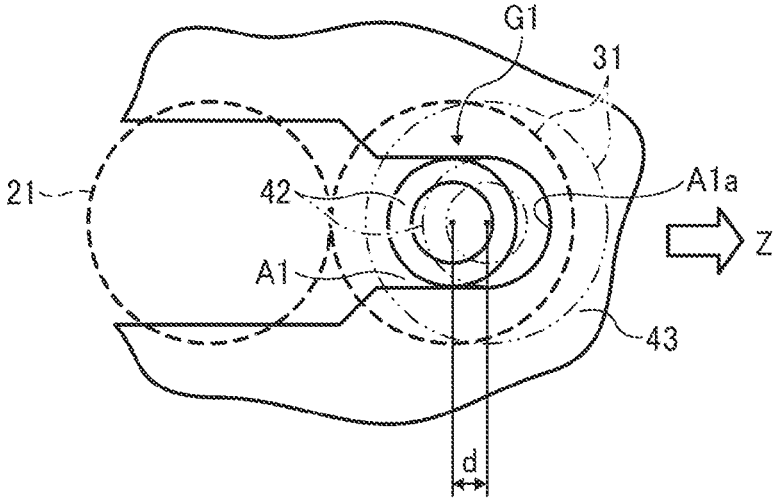
FIG. 13 is an end-on, partial elevational view of the fixing device according to one embodiment of this patent specification.

Referring to FIGS. 12 and 13, a description is now given of specific features of the fixing device 20 according to one or more embodiments of this patent specification.

FIG. 12 is an end-on elevational view of the fixing device 20 according to one embodiment of this patent specification.

As shown in FIG. 12, in the present embodiment, the releasable biasing mechanism B includes a motor-driven cam 68 and an extension spring 69 in addition to the positioning lever 63. One end of the positioning lever 63 defines an opening 63*a* within which a shaft 64 is inserted to define a rotational axis around which the lever 63 swivels or rotates. Another, free end of the positioning lever 63 is connected to the longitudinal end E2 of the pressure roller 31 via the bearing 42. The motor-driven cam 68 is positioned in contact with the free end of the lever 63 to rotate the lever 63. The extension spring 69 is connected in tension between the lever 63 and the enclosure (e.g., the sidewall 44) of the fixing device 20 to force the lever 68 clockwise in FIG. 12, which in turn forces the pressure roller 31 away from the fuser belt 21.

In the releasable biasing mechanism B, rotation of the cam 68 in turn rotates the lever 63 around the shaft 64, upon which the pressure roller 31 changes position relative to the fuser belt 21 for adjusting the pressure between the pressure roller 31 and the fuser belt 21.

Specifically, to increase pressure between the pressure roller 31 and the fuser belt 21, the controller activates the cam 68 to rotate the lever 63 in a direction counterclockwise in FIG. 12, which increases tension on the spring 69. As the cam 68 comes into a position as depicted in FIG. 12, the pressure roller 31 is in its loaded, operational position, applying an appropriate nip pressure against the fuser belt 21.

To decrease pressure between the pressure roller 31 and the fuser belt 21, the controller activates the cam 68 to rotate the lever 63 in a direction clockwise in FIG. 12, which decreases tension on the spring 69. As the cam 68 comes into a position away from that depicted in FIG. 12, the pressure roller 31 is in its unloaded position, applying reduced or no pressure against the fuser belt 21.

As used herein, the term "loaded position" is used to describe an operational position of the pressure member in which the pressure member presses against the fuser member to establish a sufficient pressure for processing a toner image through the fixing nip therebetween. The term "unloaded position" is used to describe any position in which the nip pressure is reduced or removed, including where the pressure member is out of contact with the fuser member, and where the pressure member contacts the fuser member with a contact pressure lower than that applied where the pressure member is in its loaded position as set forth herein.

The releasable biasing mechanism B may be used to release nip pressure between the pressure roller 31 and the fuser belt 21 in various occasions. Operation of the mechanism B may be controlled either manually by a human user, or automatically by a controller that directs a suitable actuator, such as a stepper motor, provided to the cam 68.

For example, where the fixing device 20 remains inactive, the pressure roller 31 may be automatically moved into the unloaded position to prevent deformation of the fuser belt 21 and the pressure roller 31, which would occur where the fixing members are continuously subjected to a substantial nip pressure for an extended period of non-operation. Further, where a paper jam occurs at the fixing nip N, the pressure roller 31 may be unloaded either manually or automatically through the releasable biasing mechanism B, as to facilitate removal of the jammed paper from between the fuser belt 21 and the pressure roller 31.

With further reference to FIG. 12, a stationary, first guide member G1 is shown defining a first elongated opening A1 extending in the load direction Z for displaceably accommodating the first longitudinal end E1 of the pressure roller 31 therein.

With additional reference to FIG. 13, which is an end-on, partial elevational view of the fixing device 20, a moveable, second guide member G2 is shown defining a second elongated opening A2 extending transversely to the load direction Z for displaceably accommodating the second longitudinal end E2 of the pressure roller 31 therein.

Specifically, in the present embodiment, the first guide member G1 is integral with or connected to a stationary enclosure in which the fixing device 20 is accommodated.

For example, as shown in FIG. 13, the first guide member G11 may be integrally formed with the first sidewall 43 of the fixing device 20, with the first elongated opening A1 being an open-ended slot or notch cut in the sidewall 43. The opening A1 may be dimensioned relative to a diameter of the bearing 42 at the first longitudinal end E1 of the roller 31, such that a width of the opening A1 is substantially equal to the bearing diameter, and a length of the opening A1 is longer than the bearing diameter.

Also, the second guide member G2 is integral with or connected to a rotatable structure that is rotatable around a rotational axis thereof.

For example, as shown in FIG. 12, the second guide member G2 may be integrally formed with the rotatable, positioning lever 63 mounted to the second sidewall 44 of the fixing device 20, with the second elongated opening A2 being an oval slot cut in the free end of the lever 63. The opening A2 may be dimensioned relative to a diameter of the bearing 42 at the second longitudinal end E2 of the roller 31, such that a width of the opening A2 is substantially equal to the bearing diameter, and a length of the opening A2 is longer than the bearing diameter.

In the present embodiment, the fixing device 20 includes a gear train through which the rotary driver 60 is connected to the second longitudinal end E2 of the pressure roller 31.

For example, as shown in FIG. 12, the gear train includes an output gear 45 attached to the second longitudinal end E2 of the pressure roller 31 to transmit torque to the pressure roller 31, and an idler gear 65 meshing with the output gear 45 and connected to the rotary driver 60 to transmit torque from the rotary driver 60 to the output gear 45, as well as an input gear 71 meshing with the idler gear 65 to transmit torque from the rotary driver 60 to the idler gear 65.

The idler gear 65 is coaxially mounted with the rotational axis of the second guide member G2. For example, the idler gear 65 may be rotatably mounted to the shaft 64 defining the rotational axis of the positioning lever 63 in which the second guide member G2 is provided.

In such a configuration, as the releasable biasing mechanism B is operated to unload the pressure roller 31, the pressure roller 31 moves away from the fuser belt 21, with the bearings 42 at its opposed longitudinal ends E displaced along the length of the elongated openings A1 and A2 in the respective guide members G1 and G2.

Specifically, at the first longitudinal end E1 of the roller 31, the bearing 42 slides along the first elongated opening A1 extending in the load direction Z in the stationary, first guide member G1, which directs the bearing 42 to move straight in the load direction Z, as shown in FIG. 13.

Simultaneously, at the second longitudinal end E2 of the roller 31, the bearing 42 slides along the second elongated opening A2 extending transversely to the load direction Z in the movable, second guide member G2, which itself is movable to allow displacement of the bearing 42 in the load direction Z, as shown in FIG. 12.

The combination of the first and second guide members G1 and G2 thus restricts movement of the pressure roller 31 to the load direction Z away from the fuser belt 21, such that the pressure roller 31 remains in proper alignment with the fuser belt 21 upon releasing nip pressure.

Further, with the second guide member G2 rotating around the shaft 64, the output gear 45 attached to the pressure roller 31 and its mating, idler gear 65 can maintain engagement with each other, which decreases progressively, but does not suddenly dissipate, as the pressure roller 31 retracts from the fuser belt 21. Moreover, gear engagement may be effectively retained where the idler gear 65 is coaxially mounted with the rotational axis of the second guide member G2, which enables coaxial rotation of the second guide member G2 relative to the idle gear 65.

For comparison purposes, and to facilitate a ready understanding of the fixing device 20 according to this patent specification, comparative examples are described below, each of which employs a different guide mechanism for guiding movement of a pressure roller 131 relative to a fuser belt 121, with reference to FIGS. 14A and 14B.

Figure 14A:
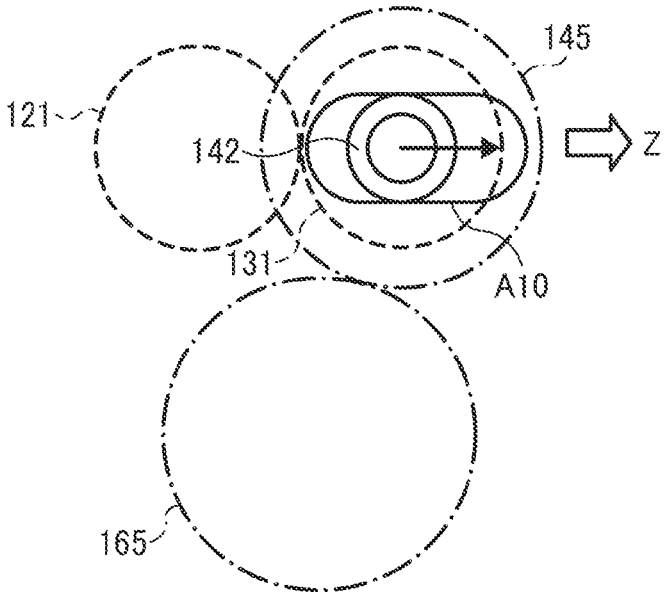
FIGS. 14A and 14B are elevational views of different guide members included in a fixing device.

As shown in FIG. 14A, the pressure roller 131 may have each of its longitudinal ends displaceably accommodated in an elongated opening A10 extending in the load direction Z, disposed in a stationary, enclosure sidewall of the fixing device.

In this arrangement, releasing nip pressure causes the pressure roller 131 to move away from the fuser belt 121 in a straight, direct path without deflection from the load direction Z. Such movement of the pressure roller 131 does not require a substantial space for accommodating the moving roller 131, while entailing a risk of sudden disengagement of an output gear 145 from the idler gear 165, which would result in damage to the gear train where adjacent gear teeth strike each other during movement of the pressure roller 131.

Figure 14B:
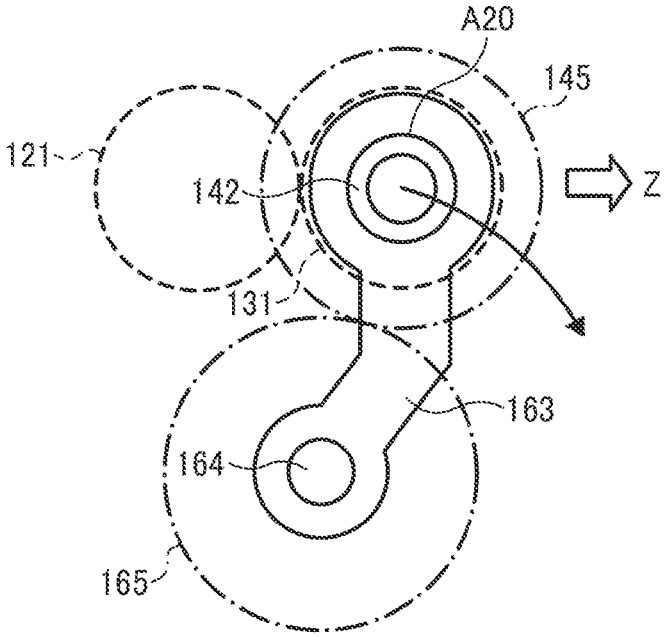

As shown in FIG. 14B, instead, the pressure roller 131 may have each of its longitudinal ends fixedly accommodated in a circular opening A20, disposed in a positioning lever 163 rotatably mounted to a shaft 164.

In this arrangement, releasing nip pressure causes the pressure roller 131 to move away from the fuser belt 121 in a curved, circumferential path around the rotational axis of the positioning lever 163. Compared to straight movement, curved movement of the pressure roller 131 allows an output gear 145 to remain in mesh with its mating, idler gear 165, thereby eliminating failure due to interference between gear teeth. However, this approach requires an extensive space for accommodating the moving roller 131. Moreover, increasing the range of movement of the pressure roller would cause increased interference of the pressure roller 131 with its surrounding structure.

For example, where the pressure roller 131 is equipped with a temperature sensor (such as one depicted in FIG. 2), pressure from the moving roller 131 would cause excessive stress on the sensing equipment, resulting in damage or deformation to a cantilevered spring on which the sensor is supported.

By contrast, with the guide mechanism according to the present embodiment, in which the first longitudinal end E1 of the roller 31 is displaceably accommodated in the first elongated opening A1 defined in the stationary guide member G1, and the second longitudinal end E2 of the roller 31 is displaceably accommodated in the second elongated opening A2 defined in the movable guide member G2, the pressure roller 31 can move relative to the fuser belt 21 in a relatively small, limited space without causing sudden disengagement of the mating gears provided to the pressure roller 31 upon releasing pressure between the pressure roller 31 and the fuser belt 21.

In further embodiment, the guide mechanism may be provided with a stopper to restrict movement of the pressure roller 31 away from the belt 21 for maintaining a constant engagement between the output gear 45 and the idler gear 61.

For example, as shown in FIG. 13, the first elongated opening A1 may have a stopper edge A1*a* shaped and positioned to allow displacement of the roller end E1 within a limited distance d in the load direction Z. The distance d is dimensioned such that movement of the pressure roller 31 does not cause complete separation of the output gear 45 from the idler gear 65. Should the pressure roller 31 be forced to move beyond the distance d, the stopper edge A1*a* contacts the roller end E1 to restrict further movement of the pressure roller 31 away from the fuser belt 21.

Although in the present embodiment, the stopper is depicted as being an edge of the first elongated opening A1, the stopper may be configured as an edge of at least one of the first and second elongated openings A1 and A2. Thus, the stopper edge may be provided to either or both of the first and second elongated openings A1 and A2.

Alternatively, instead of the opening edge, the stopper may be configured as a protrusion disposed adjacent to the pressure roller 31, such that the protrusion contacts the pressure roller 31 to restrict movement of the pressure roller 31 away from the belt 21.

Still alternatively, the stopper may be obtained through suitable modification to the cam 68 connected to the second guide member G2 for adjusting rotation of the second guide member G2 around the rotational axis thereof, such that the cam 68 limits further rotation of the positioning lever 64 to restrict movement of the pressure roller 31 away from the belt 21.

Although in the present embodiment, the elongated opening of each guide member is depicted as shaped in a particular configuration, the elongated opening may comprise any suitable shape, including, but not limited to, a notch, a slot, a slit, a groove, a hole, and any combination thereof.

For example, the first elongated opening A1 may be configured as an oval slot, instead of an open-ended slot or notch, extending in the load direction Z. Also, the second elongated opening A2 may be configured as an open-ended slot or notch, instead of an oval slot, extending transversely to the load direction Z.

Although in the present embodiment, the first guide member G1 is depicted as being integral with the sidewall 43, alternatively, instead, the first guide member G1 may be configured as a separate structure connected to the sidewall 43 by a suitable fastening device, such as a screw fastener.

Although a particular configuration has been illustrated, the fixing device 20 may be configured otherwise than that depicted primarily with reference to FIG. 2, with appropriate modifications to the material, number, size, shape, position, and other features of components included in the fixing device 20.

For example, instead of a multilayered belt, the endless, flexible fuser belt 21 may be configured as a thin film of material, such as polyimide, polyamide, fluorine rubber, metal, or the like, formed into an endless looped configuration.

Further, instead of a halogen heater disposed inside the loop of the belt 21 to radiate heat to the belt 21, the heater 25 may be configured as any suitable heating element including, but not limited to, a radiant heater, an electromagnetic induction heater, a planar resistance heater, and a combination thereof.

Furthermore, the heater 25 may be disposed facing a circumferential surface of the belt 21 such that heat is directly transmitted from the heater 25 to the belt 21. Alternatively, instead, the heater 25 may be used in conjunction with a heat conductor shaped into a hollow cylindrical configuration around which the belt 21 is entrained, in which case the heater 25 is disposed inside the hollow cylindrical shape of the heat conductor such that heat is transmitted from the heater to the belt 21 via the heat conductor.

In each of those alternative embodiments, various beneficial effects may be obtained from the guide mechanism for the pressure member and other aspects of the fixing device 20 according to this patent specification.

Figure 15:
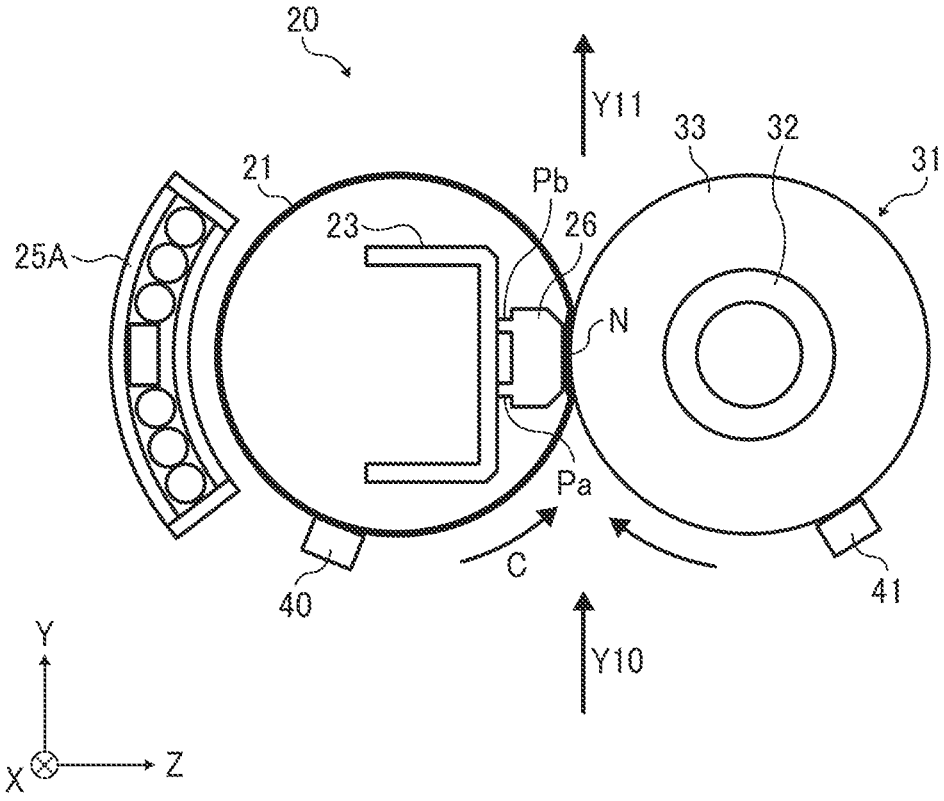
FIG. 15 is an axial cross-sectional view of the fixing device according to another embodiment of this patent specification.

FIG. 15 is an axial cross-sectional view of the fixing device 20 according to another embodiment of this patent specification.

As shown in FIG. 15, the overall configuration of the present embodiment is similar to that depicted primarily with reference to FIG. 2, including an endless flexible belt 21 looped into a generally cylindrical configuration extending in a longitudinal, axial direction X thereof for rotation in a rotational, circumferential direction C thereof; a stationary fuser pad 26 stationarily disposed inside the loop of the belt 21; and a rotatably driven, elastically biased pressure member 31 disposed parallel to the stationary pad 26 with the belt 21 interposed between the pressure member 31 and the pad 26.

Also included are a reinforcing member 23 stationarily disposed in contact with the stationary pad 26 inside the loop of the belt 21 for reinforcing the fuser pad 26, with the fuser pad 26 including two or more contact portions Pa and Pb spaced apart from each other in the conveyance direction Y, each generally extending in the longitudinal direction X of the looped belt 21 and protruding toward the reinforcing member 23 to contact the reinforcing member 23; a first temperature sensor 40 disposed facing the belt 21 to detect temperature at the belt surface; and a second temperature sensor 41 disposed facing the pressure roller 31 to detect temperature at the roller surface.

As is the case with the foregoing embodiment, the fixing device 20 is provided with the guide mechanism including the combination of a stationary guide member and a moveable guide member for guiding movement the rotatably driven, elastically biased pressure member 31, of which a further description is omitted for brevity.

Unlike the foregoing embodiment, the fixing device 20 in the present embodiment employs an induction heater 25A disposed outside the loop of the belt 21 to heat the belt 21 through electromagnetic induction.

Specifically, the induction heater 25A includes an electromagnetic inductor that consists of a set of electromagnetic coils or Litz wires each being a bundle of thinner wires extending across a portion of the fuser belt 21 in the longitudinal direction X. A semi-cylindrical main core formed of a ferromagnetic material with a high magnetic permeability ranging from approximately 1,000 to approximately 3,000 is disposed parallel with the electromagnetic coils. Optionally, auxiliary central and/or side cores may be provided for efficient formation of magnetic flux. These components of the heater 25A are supported together by a guide member formed of heat resistant resin or the like. For efficient heating of the fuser belt 21 through electromagnetic induction, the electromagnetic inductor may be positioned surrounding the entire circumference of the fuser belt 21.

In addition, a heating element is provided in the fuser belt 21 to produce heat by electromagnetic induction. For example, a heat generation layer, formed of suitable metal, including, but not limited to, nickel, stainless steel, iron, copper, cobalt, chromium, aluminum, gold, platinum, silver, tin, palladium, and alloys containing one or more of these metals, is disposed in addition to, or in place of, the multiple layers of the belt 21. Thus, an additional heat generation layer may be deposited between the elastic layer and the release coating of the belt 21. Alternatively, a heat generation layer itself may constitute a substrate of the belt 21.

During operation, the induction heater 25A generates an alternating magnetic field around the fuser belt 21 as a high-frequency alternating current passes through the electromagnetic coils. The changing magnetic field induces eddy currents over the heat generation layer of the fuser belt 21, which exhibits certain electrical resistivity to produce a corresponding amount of Joule heat from within the belt 21. Heat thus generated through electromagnetic induction is distributed throughout the length of the fuser belt 21, which heats the fixing nip N to a desired processing temperature.

In yet still further embodiment, the heater 25 may be configured as a planar resistance heater extending along and in contact with the belt in the circumferential direction thereof to generate heat for conduction to the belt.

Specifically, such a planar resistance heater may be a ceramic heater that has a resistive heating element embedded in a planar plate in contact with an outer or inner circumferential surface of the belt 21. The planar heater may cover the belt circumference either partially or entirely. Two ends of the resistive heating element are connected to a power supply from which an electric current is supplied to the resistive heating element, which in turn generates heat for conduction to the fuser belt 21 in contact with the planar plate.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable, endless flexible belt looped into a generally cylindrical configuration;

an elongated stationary pad stationarily disposed inside the loop of the belt;

a rotatable pressure member disposed parallel to the stationary pad with the belt interposed between the pressure member and the stationary pad;

a rotary driver operatively connected with the pressure member to impart torque to the pressure member;

a releasable biasing mechanism operatively connected with the pressure member to apply a releasable pressure to the pressure member against the belt in a load direction, the releasable pressure being released as the pressure member moves away from the belt;

a first guide member defining a first elongated opening extending in the load direction for displaceably accommodating a first longitudinal end of the pressure member therein; and a second guide member defining a second elongated opening extending transversely to the load direction for displaceably accommodating a second longitudinal end, opposite the first longitudinal end, of the pressure member therein.

2. The fixing device according to claim 1, wherein the first guide member is integral with or connected to a stationary enclosure in which the fixing device is accommodated, and the second guide member is integral with or connected to a rotatable structure that is rotatable around a rotational axis thereof.

3. The fixing device according to claim 2, further comprising a gear train through which the rotary driver is connected to the second longitudinal end of the pressure member.

4. The fixing device according to claim 3, wherein the gear train includes:

an output gear attached to the second longitudinal end of the pressure member to transmit torque to the pressure member; and an idler gear meshing with the output gear and connected to the rotary driver to transmit torque from the rotary driver to the output gear, the idler gear being coaxially mounted with the rotational axis of the second guide member.

5. The fixing device according to claim 4, further comprising a stopper to restrict movement of the pressure member away from the belt for maintaining a constant engagement between the output gear and the idler gear.

6. The fixing device according to claim 5, wherein the stopper comprises an edge of at least one of the first and second elongated openings.

7. The fixing device according to claim 5, wherein the stopper comprises a protrusion disposed adjacent to the pressure member.

8. The fixing device according to claim 5, wherein the stopper comprises a cam connected to the second guide member for adjusting rotation of the second guide member around the rotational axis thereof.

9. The fixing device according to claim 1, wherein the releasable biasing mechanism is provided to the second longitudinal end of the pressure member.

10. The fixing device according to claim 1, wherein the releasable biasing mechanism is provided to both the first and second longitudinal ends of the pressure member.

11. The fixing device according to claim 1, wherein the elongated opening is selected from the group consisting of a notch, a slot, a slit, a groove, a hole, and a combination thereof.

12. The fixing device according to claim 1, further comprising a temperature sensor disposed adjacent to the pressure member to measure a temperature of the pressure member.

13. The fixing device according to claim 1, further comprising a reinforcing member stationarily disposed in contact with the stationary pad inside the loop of the belt for reinforcing the stationary pad, wherein the stationary pad includes one or more contact portions spaced apart from each other in a conveyance direction in which a recording medium is conveyed between the fuser belt and the pressure member, each contact portion generally extending in a longitudinal, axial direction of the looped belt and protruding toward the reinforcing member to contact the reinforcing member.

14. The fixing device according to claim 1, further comprising a pair of retaining flanges, one connected to a longitudinal end of the looped belt, to retain the belt in the generally cylindrical configuration thereof.

15. The fixing device according to claim 1, further comprising a heater disposed adjacent to the belt, the heater being selected from the group consisting of a radiant heater, an electromagnetic induction heater, a planar resistance heater, and a combination thereof.

16. The fixing device according to claim 15, wherein the heater is disposed facing a circumferential surface of the belt such that heat is directly transmitted from the heater to the belt.

17. The fixing device according to claim 15, further comprising a heat conductor shaped into a hollow cylindrical configuration around which the belt is entrained, wherein the heater is disposed inside the hollow cylindrical shape of the heat conductor such that heat is transmitted from the heater to the belt via the heat conductor.

18. An image forming apparatus incorporating the fixing device according to claim 1.

19. A mechanism for guiding movement of a rotatable pressure member that applies a variable pressure against an opposed, rotatable fuser member in a load direction, the variable pressure varying as the pressure member moves relative to the fuser member, the mechanism comprising:

a stationary guide member defining a first elongated opening extending in the load direction for displaceably accommodating a first longitudinal end of the pressure member therein; and a moveable guide member defining a second elongated opening extending transversely to the load direction for displaceably accommodating a second longitudinal end, opposite the first longitudinal end, of the pressure member therein.

* * * * *